US005624147A

United States Patent [19]

Arteon et al.

[11] Patent Number: 5,624,147

[45] Date of Patent: Apr. 29, 1997

[54] LIFTING RING

[76] Inventors: Marcel Arteon, 16 rue Cino-del-Duca, F-92200 Neuilly-sur-Seine, France; Lucien Joannet, 37 rue de Portzmorguer, Le Couregant, F-56270 Ploemeur, France

[21] Appl. No.: 416,677

[22] PCT Filed: Aug. 11, 1994

[86] PCT No.: PCT/FR94/01000

§ 371 Date: Apr. 7, 1995

§ 102(e) Date: Apr. 7, 1995

[87] PCT Pub. No.: WO95/05335

PCT Pub. Date: Feb. 23, 1995

[30] Foreign Application Priority Data

Aug. 12, 1993 [FR] France ..... 93 09892

[51] Int. Cl.[6] ..... B66C 1/66

[52] U.S. Cl. ..... 294/89; 294/1.1; 52/125.2

[58] Field of Search ..... 294/1.1, 82.1, 294/82.24, 82.31, 89; 52/125.2–125.5

[56] References Cited

U.S. PATENT DOCUMENTS

| | | | |
|---|---|---|---|
| 3,371,951 | 3/1968 | Bryant | 294/89 |
| 4,173,367 | 11/1979 | Haeussler | 294/83 |
| 4,398,762 | 8/1983 | Haeussler et al. | 294/89 |
| 4,634,164 | 1/1987 | Fricker | 294/89 |
| 4,671,554 | 6/1987 | Lancelot | 294/82.24 |

FOREIGN PATENT DOCUMENTS

| | | |
|---|---|---|
| 1568605 | 3/1969 | France . |
| 2651521 | 3/1991 | France . |
| 9217894 | 8/1993 | Germany . |

*Primary Examiner*—Dean Kramer

*Attorney, Agent, or Firm*—Eckert Seamans Cherin & Mellott

[57] ABSTRACT

A lifting ring having a lifting shackle and a yoke for coupling to the head of an anchoring device, the yoke being pivotally mounted to the bottom portion of the lifting shackle which is formed with two toroidal surfaces. The lifting shackle is formed with an eye which opens out onto the toroidal surfaces, the eye having two coupling faces and two inclined faces forming abutments that limit the relative motion possible between the yoke and the shackle.

6 Claims, 2 Drawing Sheets

LIFTING RING

The present invention relates to a lifting ring designed for lifting, transporting, or turning over heavy loads, such as prefabricated building elements, in particular after said elements have been molded, where said elements are particularly, but not exclusively, thin panels.

BACKGROUND OF THE INVENTION

Such rings are known and used on a wide scale. Their purpose is to enable a mechanical link to be established between an anchoring device incorporated in the concrete and a hook of a hoist such as crane.

More particularly, the present invention relates to a ring designed to co-operate with an anchoring device having an eye or a tear-out cone associated with a cylindrical head, even though the ring may also be implemented with other anchoring pieces.

When the concrete is being cast, the anchoring piece projects into a void that is hemispherical or partially hemispherical so as to be accessible after unmolding or removal of shuttering.

Such a ring is described in FR-A-1 568 605 and in FR-A-2 302 398 (HAEUSSLER). It comprises a coupling piece or yoke for coupling with the head of the anchoring device and a ring proper or shackle which provides the connection between the coupling piece and the hook of the hoist.

The yoke includes a groove or slot in the form of a circular sector in which the head of the anchoring device is received. In certain known lifting rings, the spherical coupling piece is hinged to the shackle in such a manner as to be capable of pivoting between a position in which the head can be engaged and disengaged in the groove, and a transport or handling position in which the head of the anchoring device is in abutment against the bottom of the groove.

The prefabricated element can thus be transported in complete safety so long as the rated load of the anchor piece corresponds to the weight of the element. After transport, the groove can be moved relative to the head of the anchoring device until the disengagement position is reached.

The top portion of the yoke includes a hinge eye or hole extending orthogonally to the plane of the groove and located eccentrically relative to the center of the hemispherical portion. The hook-receiving shackle is itself engaged in the hole by a circular section arc or rod that enables the parts to be hinged relative to each other. In order to facilitate relative rotation between the yoke and the head of the anchoring device, it is also known to provide said part with a handling tab or arm. The tab may be remotely controlled by means of a cable.

It is necessary to prevent the shackle or coupling part spoiling the surface of the concrete which is still somewhat fresh. That is to avoid subsequent expensive finishing on-site.

OBJECTS AND SUMMARY OF THE INVENTION

An object of the present invention is to propose a lifting ring making it possible to work in complete safety, even with thin panels, while limiting the movement of the yoke relative to the shackle. To this end, the body of the yoke is hemispherical and laterally truncated so as to be capable of working with heads of anchoring devices included in narrow spaces as is made necessary by the thinness of certain prefabricated panels.

Proposals have already been made in FR-A-2 479 166 to limit such movement by acting while the yoke is in the locked position on the head of the anchoring device to bring the above-mentioned handling arm into abutment against the transverse portion that is used for this purpose in the ring of the shackle.

In the past, since the shape of the yoke has been substantially hemispherical or substantially a truncated hemisphere, the manufacturer has ensured that the hinge hole of the shackle runs into connection radii that leave a large amount of movement available, over more than 180°, with abutment being formed as mentioned above.

The idea on which the invention is based consists in using the coupling walls of the hinge hole as abutments for limiting relative motion between the yoke and the shackle.

According to the invention, the lifting ring for prefabricated building elements provided with anchoring pieces having cylindrical heads, comprises both a yoke or coupling piece for coupling with the head of the anchoring device and that includes a downwardly open semicircular T-groove of dimensions corresponding to those of the head and of the shank of the anchoring device, and a hoisting shackle on which said coupling piece is pivotally mounted by means of an eye, and wherein the eye of the coupling piece is circular in section and opens out into the truncated faces of the yoke via toroidal rings whose bottom portions are defined by two toroidal surfaces coupling with two plane faces that are inclined relative to the horizontal when the coupling piece surrounds the head of the anchoring device.

Thus, the motion or pivoting of the coupling piece relative to the shackle is automatically limited by contact between the shackle and the plane faces that form abutments for the arc of the shackle in two extreme positions.

According to another characteristic of the invention, the toroidal hinge ring is asymmetrical. That is to say it is thus possible to provide the desired displacement which need not be the same on opposite sides of the axis of the hole, by having different angles $a_1$ and $a_2$ for the inclined plane faces.

BRIEF DESCRIPTION OF THE DRAWINGS

Other characteristics and advantages of the invention appear from the following description of particular embodiments given purely as non-limiting examples, and with reference to the accompanying drawings, in which.

MORE DETAILED DESCRIPTION

Figure 1:
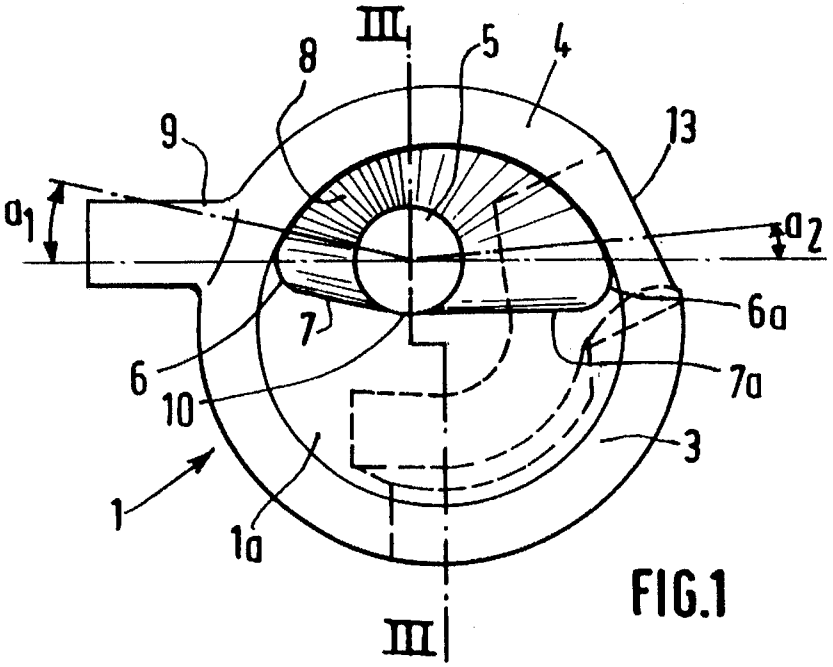
FIG. 1 is a side view of the yoke.
Figure 2:
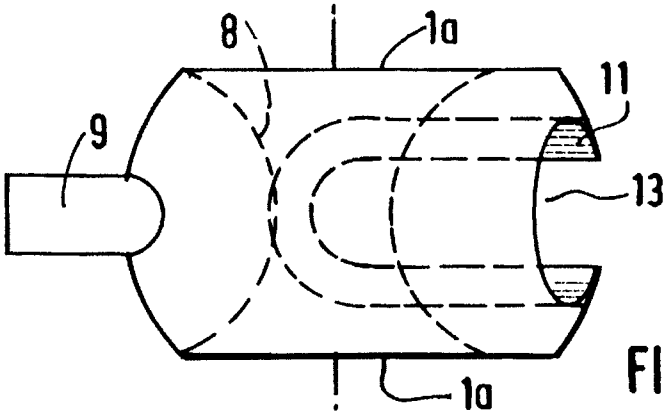
FIG. 2 is a plan view of the yoke.
Figure 3:
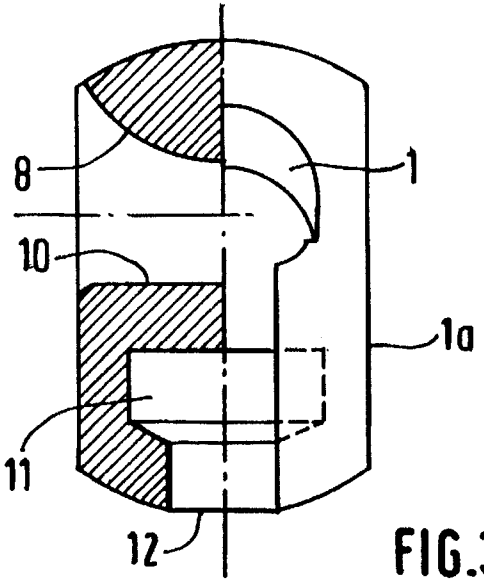
FIG. 3 is a vertical half-section view of the yoke on line III—III of FIG. 1.
Figure 4:
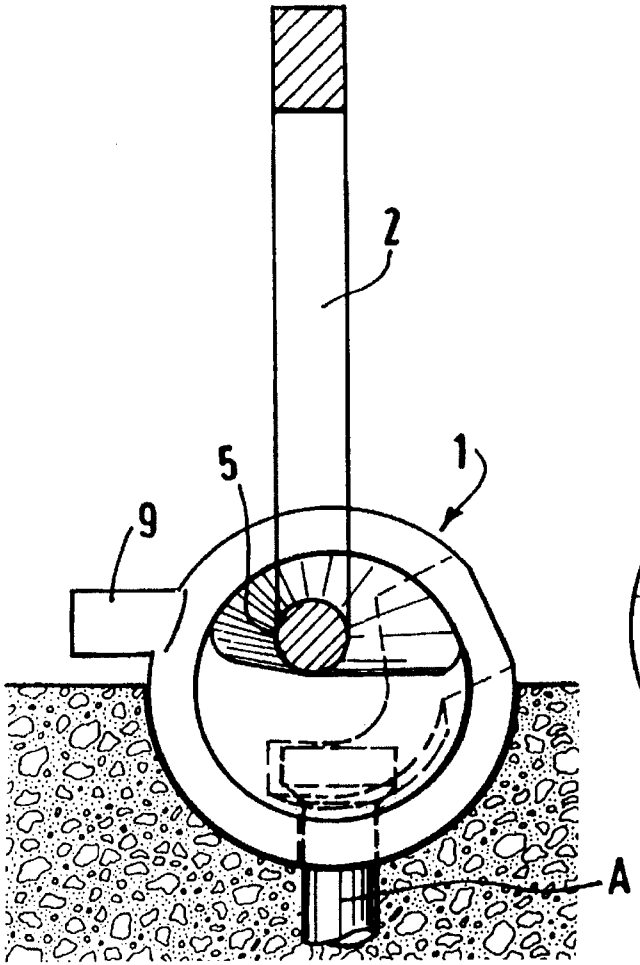
FIG. 4 is a view of the ring in its vertical traction position in line with the axis of the anchoring device.

As mentioned above, the lifting ring shown in FIGS. 4 to 6 comprises a coupling piece or yoke 1 that is pivotally mounted on a shackle 2 that serves to engage a hook (not shown) itself generally connected to the slings of a hoist. As can be seen in FIGS. 1 to 3, the yoke is generally spherical in shape having two truncated faces 1*a* and comprising a bottom portion 3 and a top portion 4. The top portion 4 includes a hole or eye 5 of diameter that is slightly greater than the diameter of the bottom arc or rod 21 of the shackle that passes through the eye. The eye 5 is circular, eccentric, and opens out into the faces of the yoke 1 via respective toroidal surfaces 8 (on either side of the hole 5). The bottom portion of the displacement cavity for the shackle is constituted by two toroidal coupling faces 6 and 6*a* with inclined faces 7 and 7*a* that are substantially plane and that converge on a zone 10. These portions are inclined relative to the horizontal axis H of the eye 5 and they co-operate therewith to form respective angles $a_1$ and $a_2$ that serve to limit motion of the shackle by the construction of the yoke. The angle $a_1$ is always less than 90° and may have a value of 10°, for example. The angle $a_2$ may be equal to the angle $a_1$. However it is capable of having a value that is greater than 90°, since motion of the shackle is not a problem on the outside. The 180° complement of the angles $a_1$ and $a_2$ is preferably greater than 90° in order to prevent the yoke accidentally detaching itself from the head of the anchoring device during pivoting of the shackle.

The top portion 4 of the yoke 2 preferably has a spur 9 on which it is possible to fix, in conventional manner, a remote-control cable by fixing a tube that is terminated by a ring on the spur, thereby enabling the yoke 1 to be pivoted on the arc 21 of the shackle 2 once the panel has been put into place by the hoist. Use of the spur is restricted to the possibility of remote unhooking.

The cylindrical groove 11 can be seen in FIG. 3. The groove 11 is a T-section cylindrical groove that is open to the outside via an opening 13. The bottom portion 12 of the groove 11 is open and extends over at least one-fourth of a circle inside the hemispherical portion 3.

While the ring is in use (FIG. 4), the ring being shown in its lifting position, the spur 9 is located above the center of the sphere, thereby preventing any contact between the spur and the concrete. The head of the anchoring device A is at the bottom of the groove 11. Handling can be performed normally.

Figure 5:
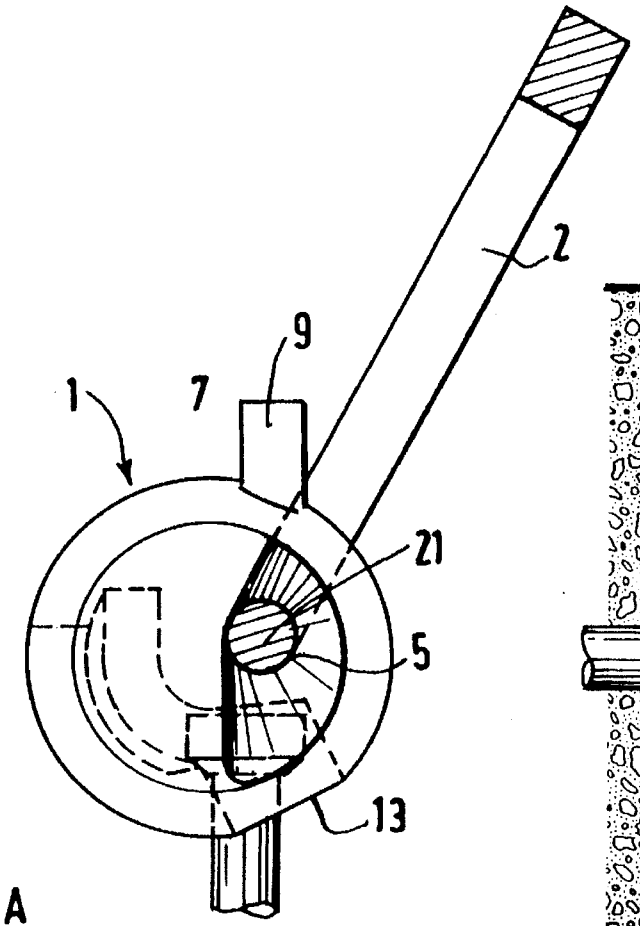
FIG. 5 is a view of the ring in its position for disengagement from or insertion on an anchoring device.

FIG. 5 shows the position of the yoke on the anchoring device A while the yoke is in its engagement or disengagement position (which positions are the same). It can be seen that in this position the surface 7 is inclined at an angle $a_1$ relative to the vertical and acts as an abutment for the shackle 2, the yoke being incapable of rotating in the clockwise direction, and being capable of rotating anticlockwise only so as to engage itself on the head of the anchor piece 1 which it receives in its groove 11. After the yoke 1 has been pivoted through 90° inside the space (no reference), then the parts take up the configuration shown in FIG. 4.

Figure 6:
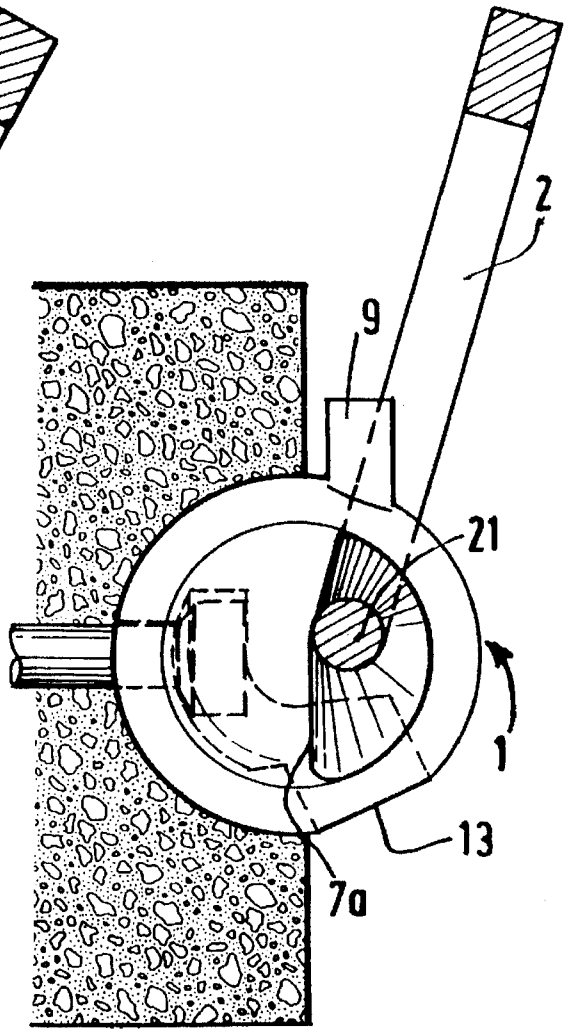
FIG. 6 is a view of the ring in position for lifting a panel.

In the two examples described above, the object of the exercise has been to lift a panel in which the anchoring device(s) is/are vertical. FIG. 6 shows an example of how lifting can be performed with the anchoring device A being in a horizontal position. The yoke 1 is engaged on the head of the anchoring device as before. Because of the abutments 6 and 6*a*, the shackle cannot rotate beyond the vertical position. When transporting the element by means of slings, the shackle is commonly inclined relative to the vertical and does not run any risk of damaging the surface of the concrete, which is the looked-for result.

Figure 7:
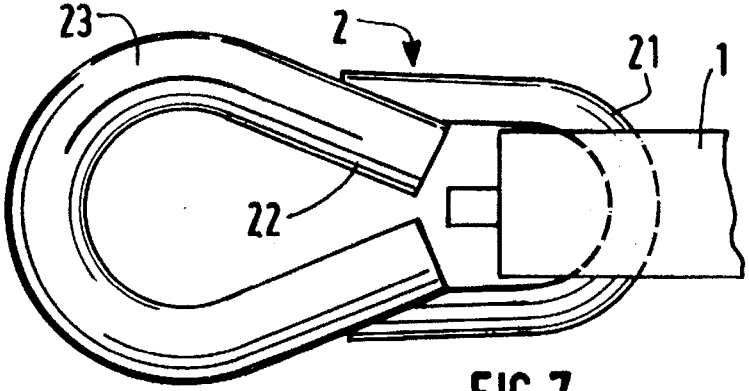
FIG. 7 is a front view of a shackle in which the yoke is mounted.

FIG. 7 shows a shackle 2 suitable for use with the yoke 1 as described above. The shackle comprises an arc 21 and another arc 23 that are assembled together by welding. Where the arcs 21 and 23 are joined together, the arc 23 is preferably narrowed at 22 so as to avoid the hook bearing directly against the yoke 1.

We claim:

1. A lifting ring for prefabricated building elements, provided with an anchoring piece having a cylindrical head and a shank about an axis of symmetry, the lifting ring comprising both a coupling piece or yoke for coupling with the head of the anchoring piece, the coupling piece being generally spherical in shape having two parallel truncated faces and including a downwardly open circular groove of dimensions corresponding to those of the anchoring piece head and shank, and a lifting shackle on which said coupling piece is pivotally mounted by means of an eye that is eccentric relative to the center of the yoke and that extends in a direction that is orthogonal to the plane of the circular groove, wherein the eye of the coupling piece is circular in section and opens out into the truncated faces of the yoke via respective toroidal surfaces whose bottom portions are defined by two toroidal coupling faces coupling with two inclined faces that are inclined about the direction perpendicular to the axis of symmetry of the anchoring device when the coupling piece surrounds the head of the anchoring device.

2. A lifting ring according to claim 1, wherein the inclined faces form angles a1 and a2 relative to said perpendicular direction, the angles a1 and a2 being less than 90° such that the inclined faces form between them an angle which is less than 180° and greater than 90°.

3. A lifting ring according to claim 2, wherein the angles a1 and a2 are equal.

4. A lifting ring according to claim 2, wherein the toroidal surfaces, coupling faces and inclined faces form clear internal abutments for the arc of the shackle, the angles a1 and a2 thereof defining the movement available to the shackle relative to the coupling piece.

5. A lifting ring according to claim 2, wherein the 180° complement of the sum of the angles $a_1$ plus $a_2$ is greater than 90°.

6. A lifting ring according to claim 1, wherein the eye has an axis of symmetry and the yoke is provided with a spur for remote identification and control that is substantially level with the axis of the eye.

* * * * *